US005877686A

United States Patent [19]

Ibey et al.

[11] Patent Number: 5,877,686

[45] Date of Patent: Mar. 2, 1999

[54] GOLF BAG THEFT PROTECTION SYSTEM

[76] Inventors: Jerry A. Ibey, P.O. Box 9106, Whittier, Calif. 90608; Larry Bradley, 13217 Hadley St., Whittier, Calif. 90601

[21] Appl. No.: 848,905

[22] Filed: May 1, 1997

[51] Int. Cl.[6] ..... G08B 13/14

[52] U.S. Cl. ..... 340/571; 200/61.52; 200/DIG. 29; 340/539; 340/568.6; 340/689; 340/693.5; 340/693.9

[58] Field of Search ..... 340/571, 568, 340/689, 686, 539, 693, 568.6, 686.1, 693.1, 693.5, 693.9; 200/DIG. 29, 61.52; 33/366

[56] References Cited

U.S. PATENT DOCUMENTS

| | | | |
|---|---|---|---|
| 3,710,371 | 1/1973 | Whalen et al. | 340/571 |
| 3,721,956 | 3/1973 | Hamann et al. | 340/571 X |
| 3,729,602 | 4/1973 | Myers | 200/61.52 |
| 3,755,778 | 8/1973 | Kennedy et al. | 340/571 X |
| 3,836,901 | 9/1974 | Matto et al. | 340/571 X |
| 3,851,326 | 11/1974 | Costa | 340/571 |
| 4,242,670 | 12/1980 | Smith | 340/568 |
| 4,279,433 | 7/1981 | Petaja | 340/571 X |
| 4,591,676 | 5/1986 | Jackman et al. | 200/DIG. 29 X |
| 4,833,456 | 5/1989 | Heller | 340/571 |
| 5,001,461 | 3/1991 | Vroom et al. | 340/571 X |
| 5,610,585 | 3/1997 | Jobe | 340/568 |

FOREIGN PATENT DOCUMENTS

| | | | |
|---|---|---|---|
| 2168149 | 6/1986 | United Kingdom | 340/689 |

*Primary Examiner*—Thomas J. Mullen, Jr.
*Attorney, Agent, or Firm*—Chris Papageorge

[57] ABSTRACT

The theft protection system includes a base unit which is sufficiently compact that it may be positioned in a pocket of a golf bag and sense unauthorized removal thereof by a thief. The base unit has a housing containing a tilt sensor which includes an electrically conducting ball positioned within a hemispherically split chamber which in response to tilt or other movement of the sensor (and golf bag) rolls into a position in which it allows current to flow through the sensor and into either just an alarm in a first embodiment or into both an alarm and a transmitter in a second embodiment. The transmitter emits a signal to a remote unit which is sufficiently compact that it may be carried by a user and which includes a receiver and an auditory or vibration alarm. The receiver activates the auditory or vibration alarm in response to receipt of the signal from the transmitter thereby alerting the user to theft or attempted theft of the golf bag.

25 Claims, 5 Drawing Sheets

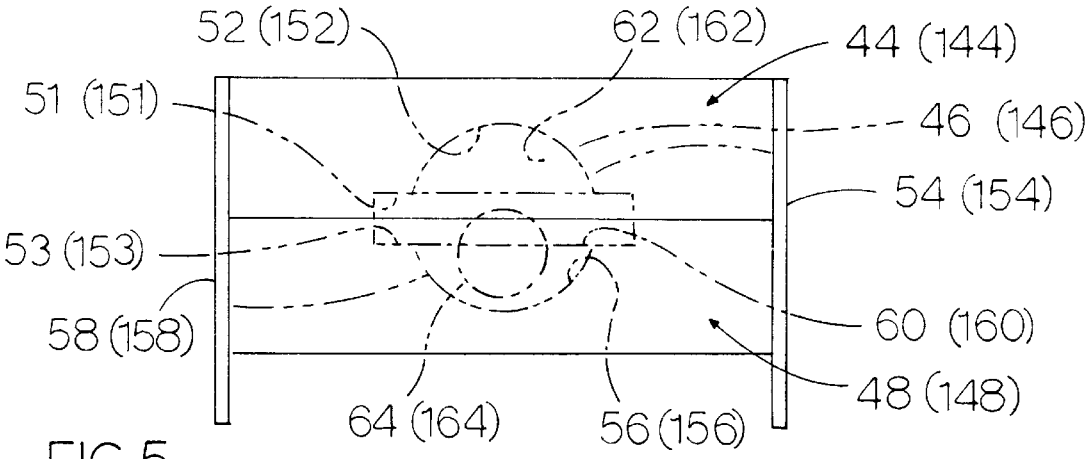
FIG.5
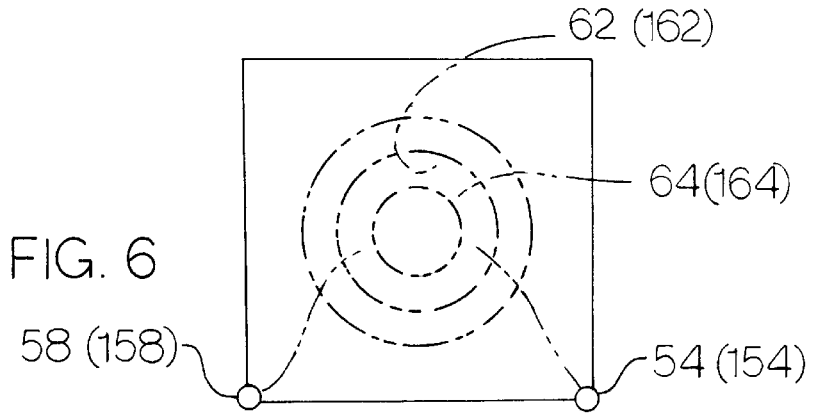
FIG. 6
FIG.7
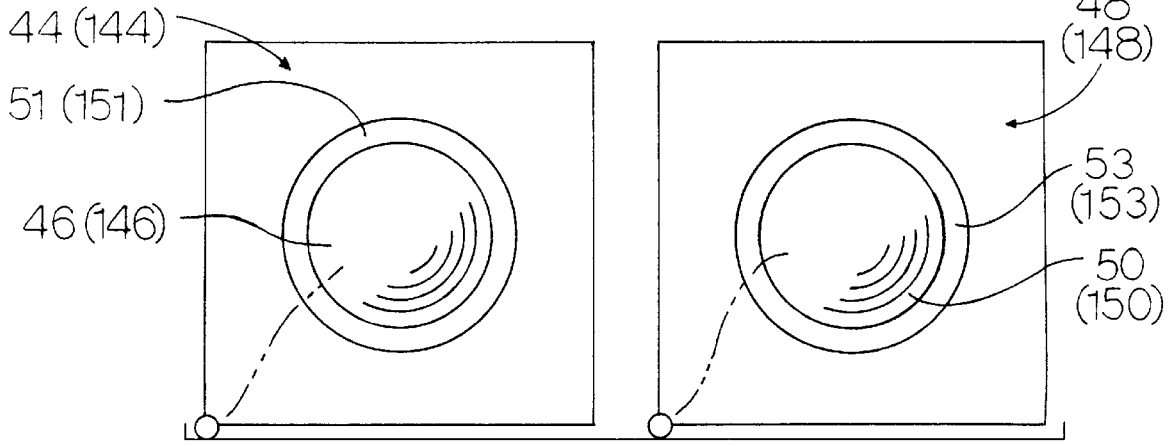

GOLF BAG THEFT PROTECTION SYSTEM

BACKGROUND OF THE INVENTION

The invention relates generally to theft protection systems for personal property and, more particularly, to such systems which may be removably positioned in or on various types of property. The system deters and/or thwarts theft by utilizing an alarm and a radio transmitter/receiver subsystem to alert the owner of the property of an attempted theft.

With the proliferation of leisure time activities designers of equipment for such activities have sought to make substantial improvements in the performance of such equipment. The performance improvement has been brought about at least partly by the utilization of increasingly more sophisticated designs and more expensive materials used in equipment used for such activities which have resulted in increasingly more expensive equipment. Consequently, the high performance and/or high tech aspect of many types of such equipment which has made them much more expensive than previous versions has produced increasingly higher incidence of theft of such equipment. Moreover, the increased popularity of such activities has produced a burgeoning demand for such types of equipment which are priced relatively inexpensively. Consequently, this burgeoning demand in combination with the high cost of such equipment has caught the attention of both amateur and professional thieves. Since such types of equipment are often designed so that they are compact or relatively light weight, they may be easily picked up and carried away by a thief. In addition, such equipment is often at a golf course or other recreational area where it is impractical to lock up the equipment. The lack of serial numbers on such equipment also makes it more difficult to identify such property as stolen and thus more attractive for would be thieves and also makes thievery of such equipment much more lucrative. In addition, this characteristic makes it not only more difficult to retrieve stolen property and return it to its rightful owner but also makes it more difficult to convict the thief. Consequently, a burgeoning black market for such equipment comprising stolen property has proliferated.

In an attempt to thwart theft of such equipment, many theft protection system and device designs have been marketed. Some of these systems and devices have been designed specifically for certain types of sporting equipment. An example of such a system designed specifically for protecting golf bags is disclosed in U.S. Pat. No. 5,041,815 to Newton. The Newton system is portable and adapted for positioning thereof in a golf bag and sounding an alarm when the bag is moved. The Newton system utilizes a mercury switch (and a weight sensitive switch) which results in activation of the alarm when the bag is moved or when one or more of the golf clubs is removed from the bag. However, a primary disadvantage of such a system is that it is designed for connection to a golf cart battery and thus is limited to those applications and situations in which such a battery is available. In addition, such systems are not able to alert the owner of the golf bag of an attempted theft if the owner is too remote from the golf bag to hear the alarm. Moreover, the mercury used in the tilt switch of such systems presents a health hazard to those who use or carry such systems. Also, such mercury tilt switches may not respond effectively to changes in all possible angles of tilt and consequently might not be able to respond to all manner of removal by a thief. In addition, such mercury switches may produce false alarms because they cannot reliably distinguish between actions of the golf bag being lifted and carried away and being simply jarred as when someone innocently bumps into the golf bag or cart.

Some other types of alarm systems have remote capabilities for alerting a person who may be at a remote location. An example of such a device is disclosed in U.S. Pat. No. 4,931,772 to Bechtold which utilizes a radio frequency transmitter adapted to be worn by a worker and a radio frequency receiver for positioning at a location remote from the worker. The transmitter includes a mercury switch which senses when the worker gets out of his normal working position thereby indicating that the worker is in jeopardy or is ill and activates the transmitter to transmit a signal to the receiver and activate an alarm. However, as with the Newton design, such mercury switch components are not safe and may produce false alarms. In addition, the Bechtold system does not have a provision for setting the angle of tilt needed to activate the alarm. Moreover, as with the Newton system, the Bechtold system is not capable of distinguishing between accidental bumping and the desired activating movements.

Other types of theft protection systems enable the user to set the tilt angle of the mercury switch of the device. An example of such a system is disclosed in U.S. Pat. No. 5,162,778 to Williamson. The Williamson mercury switch enables the user to set the rest position of the sensor at a desired tilt angle so that the degree of tilt required to activate the alarm may be set. However, the Williamson switch subsystem is not able to distinguish between accidental bumping and the desired activating movements and is more likely to give false alarms when the rest position of the switch is set so that less tilt is required to activate the alarm.

The above described prior art patented systems do not have the capability of distinguishing between movements of the alarm device comprising a theft and movements of the alarm device not comprising a theft i.e., accidental bumping. In addition, since these prior art patented systems and other typical prior art theft protection systems rely on mercury switches to provide tilt and motion detection, these systems are not safe because there is the possibility that the mercury may leak out of the switch due to damage thereto or by other means and thereby present a highly toxic chemical threat to the user or to others. What is thus needed is a theft protection system that is relatively safe and that provides more reliability in detection of attempted theft.

SUMMARY OF THE INVENTION

It is a principal object of the present invention to provide a theft protection system having a tilt and movement detection subsystem able to distinguish between tilt and movements thereof comprising an attempted theft and tilt and movements thereof not comprising an attempted theft.

It is an object of the present invention to provide a theft protection system which does not utilize toxic chemicals for enhanced safety.

It is an object of the present invention to provide a theft protection system which is compact and lightweight so that it may be readily positioned on or in a variety of types of personal property.

It is an object of the present invention to provide a theft protection system which provides no battery current drain during use while in standby mode for prolonging service thereof.

It is another object of the present invention to provide a theft protection system which is capable of responding to tilt and movement in any horizontal direction.

It is also an object of the present invention to provide a theft protection system which is capable of alerting a user situated at a location remote from the property protected of an attempted theft thereof.

It is also an object of the present invention to provide a theft protection system which has auditory alarm capabilities.

It is also an object of the present invention to provide a theft protection system which has vibration alarm capabilities.

It is also an object of the present invention to provide a theft protection system which is removably securable to personal property.

Essentially, the theft protection system of the present invention is an electronic system which provides a reliable means for alerting the user of an attempted theft of personal property. The system or components thereof may be attached to or within personal property to be protected. The system is capable of responding generally solely to attempted theft of personal property. The theft protection system accomplishes this by utilizing a unique tilt and movement detection subsystem (or sensor) which incorporates an electrically conducting ball movably mounted within an electrically conducting chamber. The ball is free to move in any direction within the chamber in response to tilt and/or movement of the detection subsystem. The ball and chamber are part of an electronic circuit and the unique design of the ball and chamber in combination with the relative dimensions thereof allow it to close the circuit of the detection subsystem in response to only a substantial degree of tilt or a substantial amount of movement and not in response to a very brief tilt or movement. The unique ball and chamber design thus enable the sensor to distinguish between actions constituting attempted theft and other actions not constituting attempted theft.

The tilt and movement sensor and an alarm are mounted within a housing which is relatively compact so that it will fit within a pocket of a golf bag. The housing preferably includes mounting ears so that it may be conveniently secured within a zippered compartment of the golf bag. With the unique sensor design, normal shuffling or jostling of the golf bag will not cause the sensor to respond and thus will not activate the alarm. Thus, the user can more confidently rely on the system to alert him to attempted theft of his golf bag without producing false alarms which may be embarrassing or which may necessitate wasteful efforts involving checking the protected property to determine if there has been an attempted theft.

In a second embodiment of the invention, the housing also includes a radio transmitter which is responsive to the sensor and which emits a signal to a separate receiver. The receiver is electrically and operatively connected to a second alarm. The receiver and the second alarm are both mounted within an enclosure which is preferably carried by the user. Thus, in response to tilt or movement of the housing, both alarms are activated; the first alarm is activated primarily to scare off the thief and the second alarm is activated to alert the owner of the attempted theft.

Although the theft protection system is designed especially for protection of golf bags, it is sufficiently compact and light weight that it may also be utilized to protect other types of personal property as well. It may, for example, be placed in a briefcase or piece of luggage and sound an alarm when it is picked up or tilted as during an attempted theft thereof. In addition, many other types of bags or containers or other types of personal property may also be protected by simply placing the theft protection system in a suitable container with such types of personal property. Also, the theft protection system may be secured directly onto a cellular telephone or scuba gear or other suitable type of sporting equipment and thereby utilized to protect it from theft. In addition, the theft protection system may be secured to a laptop computer or any of a variety of other types of personal property which require protection from theft.

BRIEF DESCRIPTION OF THE DRAWINGS

FIG. 5 is a front plan view of the tilt and movement sensor component which is common to both the first and second embodiments of the invention showing the electrically conducting ball and cavities thereof in phantom.

FIG. 6 is a top plan view of the tilt and movement sensor component of FIG. 5 also showing the electrically conducting ball and cavities thereof in phantom.

FIG. 7 is a plan view of the tilt and movement sensor component of FIGS. 5 and 6 in which the upper and lower blocks thereof are positioned side by side to show the faces of the blocks and the cavity walls thereof more clearly.

DETAILED DESCRIPTION OF THE PREFERRED EMBODIMENT

Figure 1:
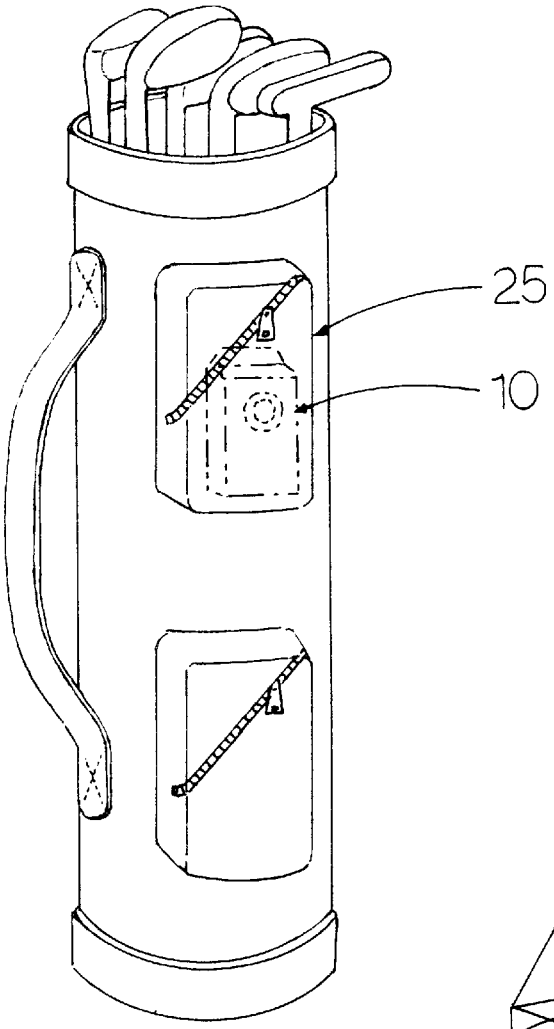
FIG. 1 is a perspective view of a first embodiment of the invention positioned in a pocket of a conventional golf bag and shown in phantom.
Figure 2:
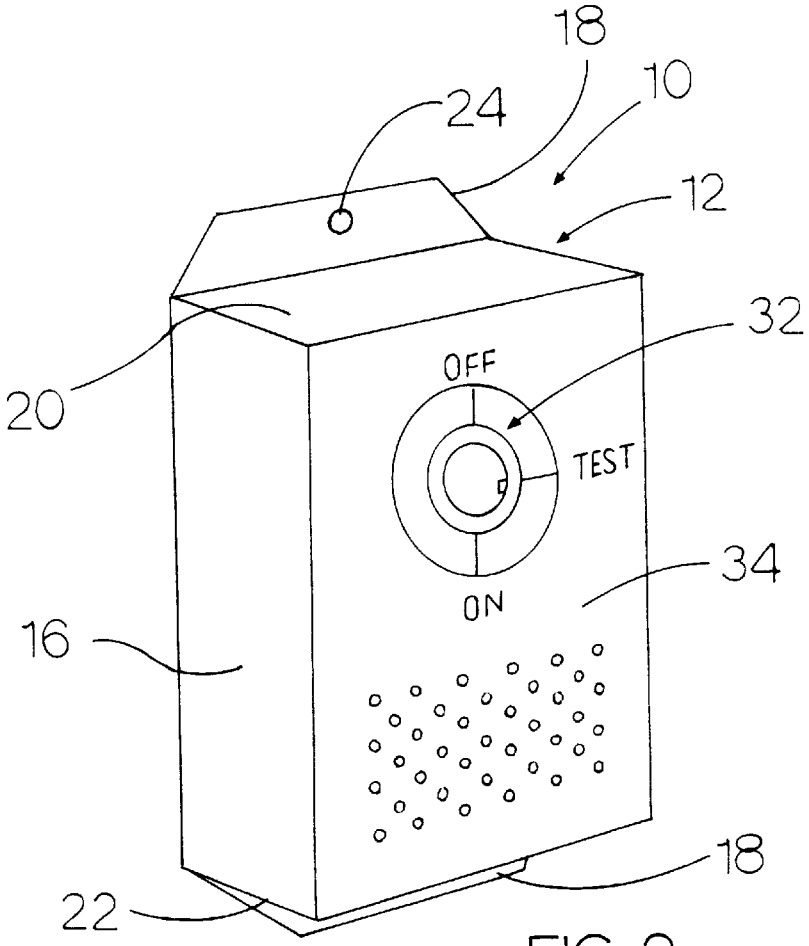
FIG. 2 is a perspective view of the first embodiment of the invention showing the control switch and mounting structures thereof.
Figure 3:
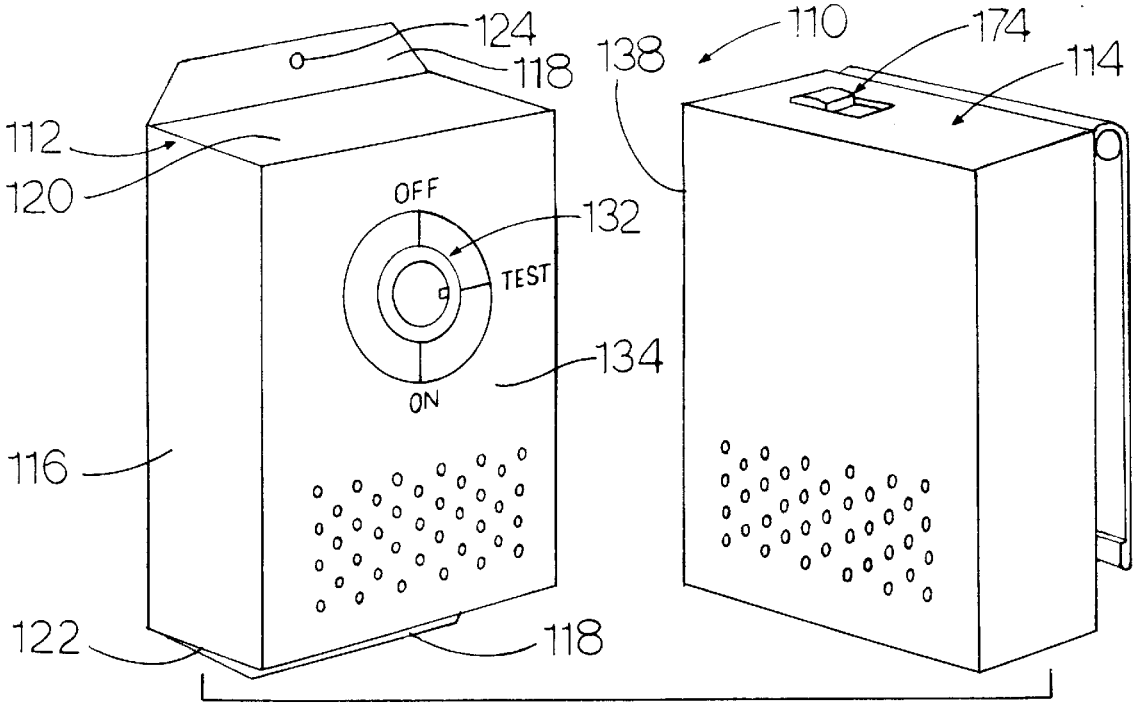
FIG. 3 is a perspective view of a second embodiment of the invention showing the component base and remote units thereof.

Referring now to the drawings, the first embodiment of the theft protection system of the present invention is generally designated by the numeral 10. The theft protection system 10 includes a base unit 12. The base unit 12 is preferably approximately four and one-quarter inches by two and five-eighths inches by five-eighths inches so that it is sufficiently compact that it fits within a pocket 25 of a typical golf bag, as shown in FIG. 1. The base unit 12 preferably includes a housing 16 which preferably includes mounting ears 18 at the top and bottom ends 20 and 22 thereof, as shown in FIG. 2. The ears 18 preferably include apertures 24 which are preferably three-sixteenths of an inch in diameter. The ears 18 in combination with the apertures 24 allow the housing 16 to be secured within a zippered pocket of a conventional golf bag.

The housing 16 preferably also encases a multi-axis tilt and movement sensor 26 and an auditory alarm 28. The tilt and movement sensor 26 is electronically connected to the alarm 28 for activation thereof via electronic circuitry 30 and electronic components thereof which are described in detail hereinbelow. The sensor 26 is preferably responsive at a minimum only to that threshold degree of tilt and movement deemed to constitute theft or attempted theft. Thus, tilt or movement of the base unit 12 such as would occur during innocuous jostling or shuffling of the golf bag is lower than that threshold degree of tilt or movement and thus will not activate the sensor 26 and consequently not activate the alarm 28. The system 10 consequently obviates or at least minimizes the likelihood of generating false alarms. The alarm 28 provides sufficient sound intensity to alert the user of an attempted theft and/or to scare off the would be thief. The preferred sound intensity level is approximately one hundred and ten decibels. However, the sound intensity level may be either more or less than this if deemed more desirable for applications other than protection of golf bags and equipment therein. The housing 16 also includes a three position control switch 32 for switching the system 10 on and off as well as for testing operational function thereof. The control switch 32 is preferably a rotary type of manual switch preferably mounted on the facia 34 of the housing 16. More specifically, the switch 32 preferably is of the type which requires a key (not shown) for operation thereof in order to prevent unauthorized persons from disabling the base unit 12. The housing also includes a battery 33 for powering the alarm 28 as well as the electrical components and electronic circuitry of the base unit 12.

A second embodiment 110 of the invention provides the added feature of alerting the user who may be at a substantial distance from the base unit 112. In addition to all the components described above with respect to embodiment 10, embodiment 110 also includes a remote unit 114. The second embodiment 110 also provides the added feature of radio communication between the base unit 112 and a remote unit 114 which may be carried by the user or placed nearby. The remote unit 114 includes a second auditory alarm 136 which is responsive to radio communication from the base unit 112. Alternatively, however, the alarm 136 may be a vibration alarm or provide both auditory and vibration output, if desired. Remote unit 114 includes an enclosure 138 within which the alarm 136 is mounted. Radio communication between unit 112 and 114 is provided by inclusion of a radio transmitter 140 mounted in housing 116 and inclusion of a radio receiver 142 mounted in enclosure 138. A battery 133 mounted in the housing 116 powers the radio transmitter 140 as well as the alarm 128 and the other electronic components and electrical circuitry in the housing 116. A battery 143 mounted in the enclosure 138 powers the radio receiver 142 as well as the alarm 136 and the other electronic components and electrical circuitry in the enclosure 138.

Embodiment 110 also utilizes a multi-axis sensor 126 which is preferably identical to that of embodiment 10. Both sensors 26 and 126 include a pair of blocks (or casing) having hemisperical cavities at the faces thereof. The blocks are situated so that they are in face to face relationship to each other, as shown in FIG. 5. Each of the pair of blocks (or casing) comprises an upper block 44 and 144 having an upper cavity 46 and 146 and a lower block 48 and 148 having a lower cavity 50 and 150. Upper cavity walls 52 and 152 are preferably electrically conducting and electrically connected to post 54 and 154. Lower cavity walls 56 and 156 are preferably electrically conducting and electrically connected to post 58 and 158 which (along with posts 54 and 154) enable the sensor 26 and 126 to be mounted on a suitable circuit board (not shown). However, the blocks 44, 144, 48 and 148 are preferably composed of an electrically insulating material so that the upper block 44 and 144 is electrically insulated from the lower block 48 and 148 and so that they are electrically insulated from the cavity walls 52, 152, 56 and 156. Walls 52, 152, 56 and 156 are preferably composed of a precious metal in order to minimize corrosion and thereby prolong the useful life of the sensor 26 and 126. Blocks 44, 144, 48 and 148 are preferably separated by a gap 60 and 160 dimensioned so that the electrically conducting walls of each cavity are electrically isolated from each other. The walls 52, 152, 56 and 156 of the pairs of cavities 52, 152, 56 and 156 partly define a chamber 62 and 162 within each of which is positioned a ball 64 and 164. The chamber 62 and 162 comprises the cavities 52, 152, 56, 156 and the gap 60 and 160. The ball 64 and 164 is electrically conducting and freely movable within the chambers 62 and 162 so that it can roll along the walls into a position in which it contacts the walls of the upper and lower cavities and thus electrically interconnect the upper and lower cavities. In addition, the blocks 44, 144, 48 and 148 have recesses 51, 151, 53 and 153 located at the faces thereof and at the perimeter of the cavities 46, 146, 50 and 150. The recesses 51, 151, 53 and 153 have walls 55, 155, 57 and 157 which partly define the gap 60 and 160 between the blocks and the cavities. In operation, when the sensor 26 and 126 is tilted, the ball 64 and 164 rolls along the walls of the chamber until it enters the area of the gap and contacts and electrically interconnects the upper and lower cavities thereby activating the sensor 26 and 126. However, if the sensor 26 and 126 is tilted less than this threshold degree, the ball does not roll up the cavity walls enough to contact and electrically interconnect the upper and lower cavity walls and thus does not activate the sensor 26 and 126. Moreover, sudden and brief movement (or tilting) of the sensor 26 and 126 such as may occur in jostling or shuffling of the golf bag merely causes the ball to bounce around in the chamber and consequently does not result in interconnection of the upper and lower cavities and therefore does not result in activation of the sensor 26 and 126. In order to more assuredly accomplish this goal, the ball is dimensioned so that its diameter is approximately equal to the radius of the chamber (or, more accurately, the radius of the upper and lower cavities). However, the relative dimensioning of the ball and chamber may be more or less than this if desired in order to adjust the amount of sudden movement which can trigger the sensor 26 and 126. Thus, the unique structure and dimensioning of the ball and chamber provides the desired tilt and movement detection while obviating the likelihood that movements of the sensor (and thereby the base unit 12 and 112) which do not constitute a theft or attempted theft will activate the sensor 26 and 126 causing a false alarm. The sensor 26 and 126 is preferably compact, and its dimensions are preferably approximately three-quarters of an inch by three-quarters of an inch by three-eighths of an inch. It is also important that the sensor 26 and 126 does not utilize or contain mercury or any other type of toxic chemical within the chamber.

Figure 4:
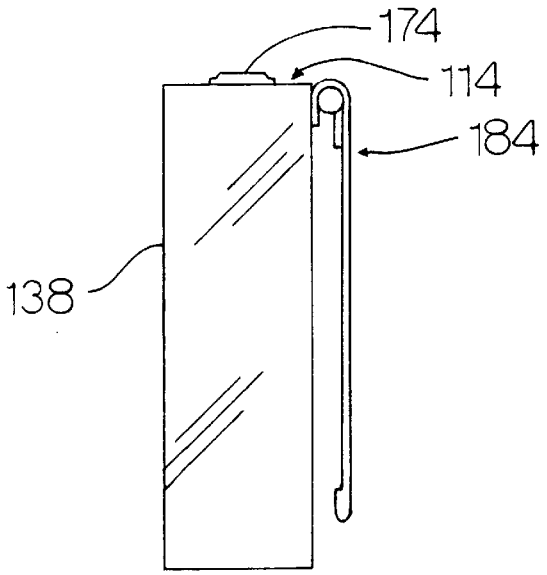
FIG. 4 is a side view of the remote unit of the second embodiment showing the belt clip structures thereof.

As shown in FIG. 4, the enclosure 138 preferably includes a belt clip device 184 to facilitate carrying thereof by the user. However, another type of suitable user securement device or structure may alternatively be utilized, if desired.

Figure 8:
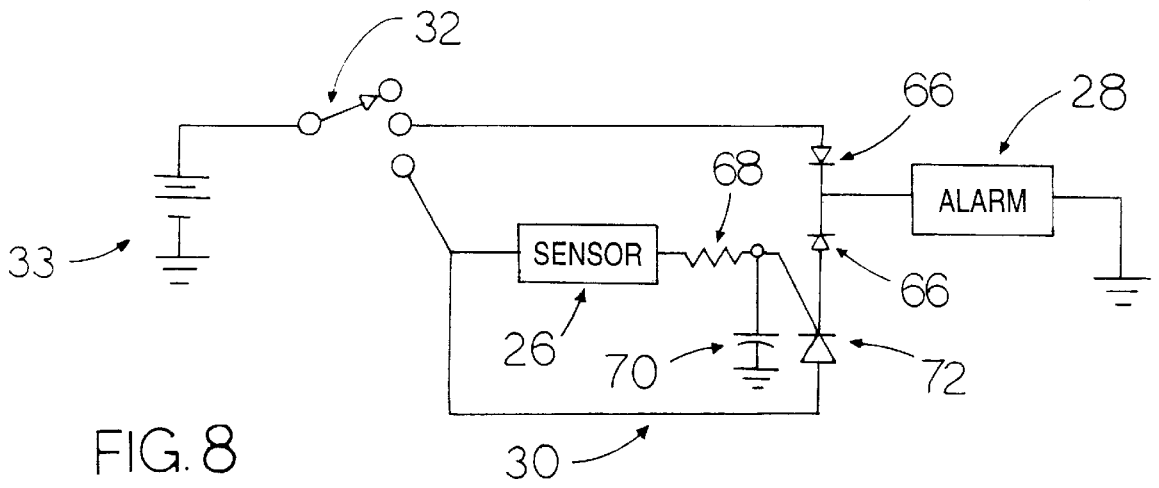
FIG. 8 is a schematic diagram of the first embodiment of the invention.
Figure 9:
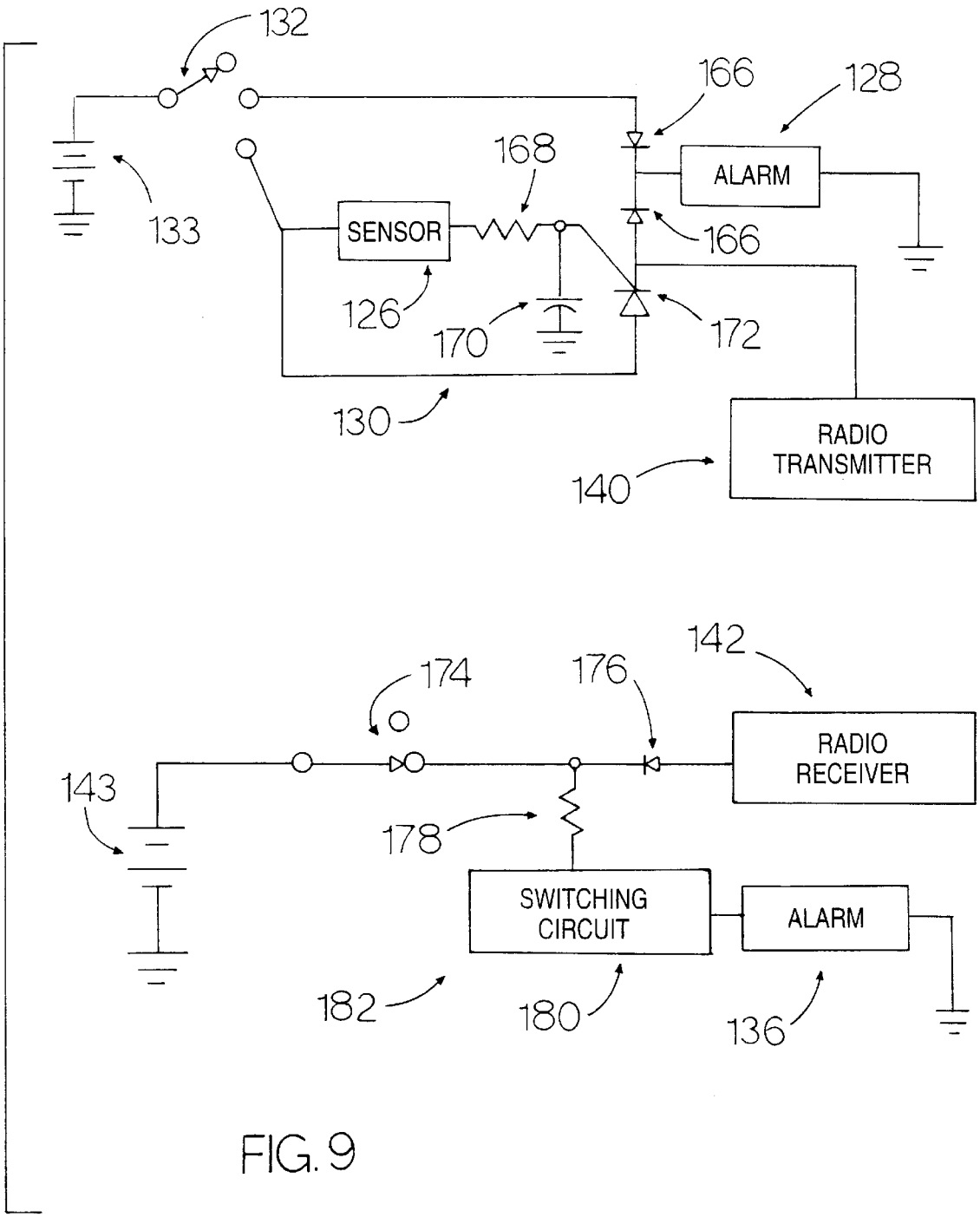
FIG. 9 is a schematic diagram of the second embodiment of the invention.

FIGS. 8 and 9 show the schematic diagrams of the first and second embodiments 10 and 110. The schematic diagrams have certain electronic components and electronic circuitry in common. The schematic diagrams of both embodiments both include the battery 33 and 133 which is connected to the control switch 32 and 132 the test terminal of which is connected to a pair of diodes 66 and 166 and the on terminal of which is connected in parallel to the sensor 26 and 126, resistor 68 and 168, capacitor 70 and 170 and one terminal of a silicon controlled rectifier 72 and 172 and to simply the other terminal of the silicon controlled rectifier 72 and 172. Thus, the battery 33 and 133, the control switch 32 and 132 and the alarm 28 and 128 are connected to the base electronic circuitry 30 and 130 described specifically hereinabove. Both the test and on terminals of the switch 32 and 132 are also electrically connected to the alarm 28 and 128. In operation, activation of the sensor 26 and 126 momentarily sources positive voltage through the resistor 68 and 168 and triggers the silicon controlled rectifier 72 and 172 into a conductive state which by its internal construction remains on and in turn drives the alarm 28 and 128. In addition, when placed in the test mode, the alarm 28 and 128 emits an acknowledgement tone to signal the user that the base unit is operationally functional. Capacitor 70 and 170 is used for filtering stray noise and the two steering diodes 66 and 166 are used to direct the voltages in the proper direction so that these electronic components function to provide circuit stability. It is also important that when in the on state the electronic components and circuitry of the base unit 12 and 112 do not produce a current drain on the battery 33 and 133 thereby resulting in long operational life of the system.

The base unit 112 of the second embodiment 110 additionally includes the radio transmitter 140 which is also powered by the battery 133. In addition, the second embodiment 110 includes the circuitry and electronic components of the remote unit 114 which are simply the remote battery 143 which is electrically connected to the remote on-off switch 174, remote diode 176, remote resistor 178, switching circuit 180, the radio receiver 142 and the second alarm 136, as shown in FIG. 9. The diode 176, resistor 178 and switching circuit 180 comprise the remote electronic circuitry 182. In operation, activation of the sensor 126 activates the radio transmitter which in response thereto emits a radio signal that is received by the radio receiver which generates an electrical signal which is transmitted to and which activates the alarm 136. Although the electronic components and electronic circuitry of both embodiments have been specifically described in detail in the schematic diagrams of FIGS. 8 and 9, other arrangements of these electronic components and other electronic components and other electronic circuitry designs may also be utilized to achieve the same objectives of the invention.

Both the housing 16 and 116 and the enclosure 138 are preferably composed of a suitable plastic material to minimize weight of the units. For the same reason, the electronic components of the units 12, 112 and 114 are dimensionally small and also composed of suitable lightweight materials.

Accordingly, there has been provided, in accordance with the invention, a system which in response to tilt or movement of an item of protected property activates an alarm to thwart attempted theft thereof or alert of actual theft thereof and thus fully satisfies the objectives set forth above. It is to be understood that all terms used herein are descriptive rather than limiting. Although the invention has been specifically described with regard to the specific embodiments set forth herein, many alternative embodiments, modifications and variations will be apparent to those skilled in the art in light of the disclosure set forth herein. Accordingly, it is intended to include all such alternatives, embodiments, modifications and variations that fall within the spirit and scope of the invention as set forth in the claims hereinbelow.

What is claimed is:

1. A theft protection system for personal property, comprising:

a housing for removable positioning thereof in or on the personal property;

a tilt and movement sensor mounted in said housing, said sensor including a casing having a chamber and an electrically conducting ball movably mounted in said chamber, said chamber comprising a pair of walls defining a pair of cavities, said pair of walls having a gap at adjacent peripheral edges thereof completely separating said pair of cavities;

an alarm mounted in said housing;

a battery mounted in said housing;

electronic circuitry for activating said alarm in response to tilt or movement of said sensor sufficient to trigger said sensor to allow current to flow within said circuitry and activate said alarm, said circuitry connected to said alarm and to said battery and mounted in said housing.

2. The theft protection system of claim 1 further including a control switch connected to said electronic circuitry, said control switch providing alarm operation test capability.

3. The theft protection system of claim 1 wherein said ball is sufficiently smaller than said chamber to preclude minimal tilt of said sensor from causing said ball to move into electrical contact with said walls of both cavities thereby otherwise closing the circuit of said electronic circuitry and to preclude innocuous jarring of said sensor from causing said ball to move into electrical contact with said walls of both cavities thereby undesirably closing the circuit of said electronic circuitry.

4. The theft protection system of claim 3 wherein said cavities are hemispherical and have a radius approximately equal to the diameter of said ball so that said ball rolls freely within said chamber and comes into contact with said walls of both said cavities in response to a predetermined degree of tilt of said sensor.

5. The theft protection system of claim 1 wherein said sensor includes solely a pair of electrically conducting posts for mounting said sensor directly on a circuit board of said electronic circuitry and electrically connecting said sensor to said electronic circuitry and wherein said casing is composed of an electrically nonconducting material so that said casing does not interfere with current flow in said electronic circuitry.

6. The theft protection system of claim 1 wherein said housing is dimensioned to fit within a standard sized golf bag pocket.

7. The theft protection system of claim 1 wherein said housing includes mounting ears having holes for removable securement of said housing to a golf bag.

8. A theft protection system for personal property, comprising:

a housing for removable positioning thereof in or on the personal property;

a tilt and movement sensor mounted in said housing;

an alarm mounted in said housing;

a battery mounted in said housing;

electronic circuitry for activating said alarm in response to tilt or movement of said sensor sufficient to trigger said sensor to allow current to flow within said circuitry and activate said alarm, said circuitry interconnecting said alarm and said battery and mounted in said housing, said electronic circuitry including a silicon controlled rectifier for receiving current from said sensor upon triggering thereof and in response to receiving current therefrom locking said electronic circuitry in a closed circuit state for keeping said alarm in a desired activated state, said sensor including solely a pair of electrically conducting posts for mounting said sensor directly on a circuit board of said electronic circuitry and electrically connecting said sensor to said electronic circuitry and wherein said casing is composed of an electrically nonconducting material so that said casing does not interfere with current flow in said electronic circuitry.

9. A theft protection system for personal property, comprising:

a housing for removable positioning thereof in or on the personal property;

a tilt and movement sensor mounted in said housing;

a transmitter for emitting a radio signal, said transmitter mounted in said housing;

a base battery mounted in said housing;

an enclosure for removable positioning thereof in or on a location remote from the personal property;

a receiver for receiving the signal, said receiver mounted in said enclosure, said receiver generating an output in response to the signal;

a remote alarm mounted in said enclosure;

a remote battery mounted in said enclosure;

remote electronic circuitry for activating said alarm in response to the signal received from said transmitter, said remote electronic circuitry interconnecting said receiver and said alarm;

base electronic circuitry for activating said transmitter in response to tilt of said sensor sufficient to trigger said sensor to allow current to flow within said circuitry and activate said transmitter, said base circuitry connected to said transmitter and to said base battery and mounted in said housing, said sensor including solely a pair of electrically conducting posts for mounting said sensor directly on a circuit board of said electronic circuitry and electrically connecting said sensor to said electronic circuitry.

10. The theft protection system of claim 9 further including a control switch connected to said base electronic circuitry, said control switch connected to said base electronic circuitry and providing alarm operation test capability.

11. The theft protection system of claim 9 wherein said tilt sensor includes a casing having a chamber and an electrically conducting ball movably mounted in said chamber, said chamber comprising a pair of opposing cavities having walls defining the same, said walls electrically connected to said base circuitry but insulated from each other, said ball in response to tilt of said sensor moving into a position wherein it contacts and thereby electrically interconnects said walls of said pair of cavities and closes a circuit of said electronic circuit resulting in activation of said alarm, said ball sufficiently smaller than said chamber to preclude minimal tilt or movement of said sensor from causing said ball to move into electrical contact with said walls of both cavities thereby otherwise closing the circuit of said electrical circuitry and to preclude jarring of said sensor from causing said ball to move into electrical contact with said walls of both cavities thereby otherwise undesirably closing the circuit of said electronic circuitry.

12. The theft protection system of claim 11 wherein said cavities are hemispherical and have a radius approximately equal to the diameter of said ball so that said ball rolls freely within said chamber and comes into contact with said walls of both said cavities in response to a predetermined degree of tilt of said sensor.

13. The theft protection system of claim 9 wherein said casing includes a pair of blocks positioned in face to face relationship, said pair of blocks having a gap separating them, said pair of blocks composed of an electrically insulating material so that said pair of blocks does not interfere with current flow in said base electronic circuit.

14. The theft protection system of claim 9 wherein said housing is dimensioned to fit within a standard sized golf bag pocket.

15. The theft protection system of claim 9 wherein said housing includes mounting ears having holes for removable securement of said housing to a golf bag.

16. A theft protection system for personal property, comprising:

a housing for removable positioning thereof in or on the personal property;

a tilt and movement sensor mounted in said housing, said sensor including a casing having a chamber and an electrically conducting ball movably mounted in said chamber, said chamber comprising a pair of opposing hemispherical cavities having walls defining the same, said walls electrically insulated from each other;

an alarm mounted in said housing;

a battery mounted in said housing;

electronic circuitry for activating said alarm in response to tilt or movement of said sensor sufficient to trigger said sensor to allow current to flow within said circuitry and activate said alarm, said circuitry connected to said alarm and to said battery and mounted in said housing, said walls of said pair of hemispherical cavities electrically connected to said electronic circuitry, said ball of said sensor in response to tilt thereof moving into a position wherein it contacts and thereby electrically interconnects said walls and closes a circuit of said electronic circuitry resulting in activation of said alarm.

17. The theft protection system of claim 16 wherein said ball is sufficiently smaller than said chamber to preclude minimal tilt of said sensor from causing said ball to move into electrical contact with said walls of both hemispherical cavities thereby otherwise closing the circuit of said electronic circuitry and to preclude jarring of said sensor from causing said ball to move into electrical contact with said walls of both hemispherical cavities thereby otherwise undesirably closing the circuit of said electronic circuitry.

18. The theft protection system of claim 16 wherein said hemispherical cavities have a radius approximately equal to the diameter of said ball so that said ball rolls freely within said chamber and comes into contact with said walls of both said cavities in response to a predetermined degree of tilt of said sensor.

19. A theft protection system for personal property, comprising:

a housing for removable positioning thereof in or on the personal property;

an alarm mounted in said housing;

a battery mounted in said housing;

a tilt and movement sensor mounted in said housing, said tilt and movement sensor including a casing having a chamber and an electrically conducting ball movably mounted in said chamber, said chamber comprising a pair of opposing hemispherical cavities having walls defining the same, said walls electrically insulated from each other;

electronic circuitry for activating said alarm in response to tilt or movement of said sensor sufficient to trigger said sensor to allow current to flow within said circuitry and activate said alarm, said circuitry interconnecting said alarm and said battery and mounted in said housing, said walls of said pair of hemispherical cavities electrically connected to said electronic circuitry, said ball of said sensor in response to tilt thereof moving into a position wherein it contacts and thereby electrically interconnects said walls and closes a circuit of said electronic circuitry resulting in activation of said alarm, said electronic circuitry including a silicon controlled rectifier for receiving current from said sensor upon triggering thereof and in response to receiving current therefrom locking said electronic circuitry in a closed circuit state for keeping said alarm in a desired activated state, said silicon controlled rectifier receiving current from said tilt sensor only upon triggering thereof to preclude transmission of current therethrough and through said electronic circuitry in order to preclude electrical power consumption of the system when said alarm is not activated thereby maximizing life of said battery.

20. The theft protection system of claim 19 wherein said ball is sufficiently smaller than said chamber to preclude minimal tilt of said sensor from causing said ball to move into electrical contact with said walls of both hemispherical cavities thereby otherwise closing the circuit of said electronic circuitry and to preclude jarring of said sensor from causing said ball to move into electrical contact with said walls of both hemispherical cavities thereby otherwise undesirably closing the circuit of said electronic circuitry.

21. The theft protection system of claim 19 wherein said hemispherical cavities have a radius approximately equal to the diameter of said ball so that said ball rolls freely within said chamber and comes into contact with said walls of both said cavities in response to a predetermined degree of tilt of said sensor.

22. A theft protection system for personal property, comprising:

a housing for removable positioning thereof in or on the personal property;

a base battery mounted in said housing;

a tilt and movement sensor mounted in said housing, said tilt sensor including a casing having a chamber and an electrically conducting ball movably mounted in said chamber, said chamber comprising a pair of opposing hemispherical cavities having walls defining the same, said walls electrically insulated from each other;

a transmitter for emitting a radio signal, said transmitter mounted in said housing;

an enclosure for removable positioning thereof in or on a location remote from the personal property;

a receiver for receiving the signal, said receiver mounted in said enclosure, said receiver generating an output in response to the signal;

a remote alarm mounted in said enclosure;

a remote battery mounted in said enclosure;

remote electronic circuitry for activating said alarm in response to the signal received from said transmitter, said remote electronic circuitry interconnecting said receiver and said alarm;

base electronic circuitry for activating said transmitter in response to tilt of said sensor sufficient to trigger said sensor to allow current to flow within said circuitry and activate said transmitter, said base circuitry connected to said transmitter and to said base battery and mounted in said housing, said walls of said pair of hemispherical cavities electrically connected to said base circuitry, said ball of said sensor in response to tilt thereof moving into a position wherein it contacts and thereby electrically interconnects said walls and closes a circuit of said base circuitry resulting in activation of said alarm.

23. The theft protection system of claim 22 wherein said ball is sufficiently smaller than said chamber to preclude minimal tilt or movement of said sensor from causing said ball to move into electrical contact with said walls of both hemispherical cavities thereby otherwise closing the circuit of said electrical circuitry and to preclude jarring of said sensor from causing said ball to move into electrical contact with said walls of both hemispherical recesses thereby otherwise undesirably closing the circuit of said electronic circuitry.

24. The theft protection system of claim 22 wherein said hemispherical cavities have a radius approximately equal to the diameter of said ball so that said ball rolls freely within said chamber and comes into contact with said walls of both said cavities in response to a predetermined degree of tilt of said sensor.

25. A theft protection system for personal property, comprising:

a housing for removable positioning thereof in or on the personal property;

a tilt and movement sensor mounted in said housing, said sensor including a casing having a chamber and an electrically conducting ball movably mounted in said chamber, said chamber comprising a pair of walls defining a pair of cavities, said pair of walls having peripheral edges adjacent to and facing each other, said electrically conducting ball movable between said peripheral edges for electrically interconnecting said pair of walls;

an alarm mounted in said housing;

a battery mounted in said housing;

electronic circuitry for activating said alarm in response to tilt or movement of said sensor sufficient to trigger said sensor to allow current to flow within said circuitry and activate said alarm, said circuitry connected to said alarm and to said battery and mounted in said housing, said tilt and movement sensor including solely a pair of electrically conducting posts for mounting said sensor directly on a circuit board of said electronic circuitry and electrically connecting said sensor to said electronic circuitry.

* * * * *